US012799725B2

(12) United States Patent
Zhou et al.

(10) Patent No.: US 12,799,725 B2
(45) Date of Patent: Nov. 17, 2026

(54) FLOWRATE-INCREASING DRAIN VALVE

(71) Applicant: ZHONGSHAN MEITU PLASTIC IND.CO., LTD., Zhongshan (CN)

(72) Inventors: Wenhui Zhou, Zhongshan (CN); Haojia Huang, Zhongshan (CN)

(73) Assignee: ZHONGSHAN MEITU PLASTIC IND.CO., LTD., Zhongshan (CN)

( * ) Notice: Subject to any disclaimer, the term of this patent is extended or adjusted under 35 U.S.C. 154(b) by 85 days.

(21) Appl. No.: 18/991,931

(22) Filed: Dec. 23, 2024

(65) Prior Publication Data

US 2026/0146428 A1 May 28, 2026

(30) Foreign Application Priority Data

Nov. 26, 2024 (CN) ..... 202411707187.9

(51) Int. Cl.
*E03C 1/242* (2006.01)
*E03C 1/12* (2006.01)

(52) U.S. Cl.
CPC ..... *E03C 1/242* (2013.01); *E03C 2001/1206* (2013.01)

(58) Field of Classification Search
CPC .. E03C 1/24; E03C 1/2665; E03C 2001/1206; E03D 1/34; E03D 1/35
USPC ..... 4/671–674, 378, 383, 387, 390–404
See application file for complete search history.

(56) References Cited

U.S. PATENT DOCUMENTS

| | | | | |
|---|---|---|---|---|
| 4,101,986 | A * | 7/1978 | Ng | E03D 1/142 4/402 |
| 5,148,554 | A | 9/1992 | Martin | |
| 6,715,162 | B2 * | 4/2004 | Han | E03D 1/34 4/378 |
| 6,901,610 | B1 * | 6/2005 | Jensen | E03D 1/34 4/390 |
| 2011/0126348 | A1 * | 6/2011 | Jeffers | E03D 1/34 4/378 |
| 2023/0243138 | A1 * | 8/2023 | Kondo | E03D 1/34 4/324 |
| 2024/0068216 | A1 * | 2/2024 | Smith | E03C 1/2665 |

FOREIGN PATENT DOCUMENTS

| | | |
|---|---|---|
| CN | 207277466 U | 4/2018 |
| WO | 2018/135017 A1 | 7/2018 |

OTHER PUBLICATIONS

European Patent Office, Search Report and Communication for Application No. 24222721.3, mailed on Jul. 7, 2025, pp. 1-7.

* cited by examiner

*Primary Examiner* — Tuan N Nguyen
(74) *Attorney, Agent, or Firm* — Gottlieb, Rackman & Reisman, PC

(57) ABSTRACT

A flowrate-increasing drain valve is disclosed, which may include a drain body provided with a vertically extending drain channel; a switch piece movably connected to the drain body and provided with a sealing sheet configured to be moved to open or close an upper end port of the drain channel; and a diversion piece arranged on the switch piece and located below the sealing sheet, a plurality of diversion trenches being distributed at intervals around an axis, and the diversion trenches configured for driving water to form a downward rotating motion to increase a water flowrate.

8 Claims, 6 Drawing Sheets

FLOWRATE-INCREASING DRAIN VALVE

CROSS-REFERENCE TO RELATED APPLICATIONS

This application is based on and claims the benefit of priority from Chinese Patent Application No. 2024117071879, filed on Nov. 26, 2024, the entirety of which is incorporated by reference herein.

TECHNICAL FIELD

The present disclosure relates to the technical field of sanitary ware, in particular to a flowrate-increasing drain valve.

BACKGROUND

In the sanitary ware industry, drain valves inside a toilet bowl and a wall-mounted water tank are key parts responsible for flushing excreta into a sewer. Performances of the drain valves are directly related to whether the excreta can be flushed clean and whether water and energy are saved. However, a flushing effect depends largely on a drain flowrate. With the same amount of water, if a drain rate increases, it will form a greater flushing pressure, which in turn will produce a stronger siphon effect.

The drain valve has a sealing sheet for opening or closing a drain port of the drain pipe. At the moment when the sealing sheet is moved to open the drain port, water rushes to the drain port from all directions of the drain port, forming a lot of turbulence, and a negative pressure area will be formed around the sealing sheet to slow down a downward flowrate of water, resulting in insufficient flushing pressure and general flushing effect.

SUMMARY

The present disclosure aims at solving at least one of the technical problems in the existing technology. In view of this, an object of the present disclosure is to propose a flowrate-increasing drain valve which can increase a flow rate and improve a flushing pressure of a water-flowrate by guiding the water-flow downward in a preset direction.

A flowrate-increasing drain valve according to an embodiment of the present disclosure comprises: a drain body, wherein the drain body defines a vertically extending drain channel; a switch piece movably connected to the drain body and having a sealing sheet capable of being moved to open or close an upper end port of the drain channel; and a diversion piece arranged on the switch piece and located below the sealing sheet, wherein a plurality of diversion trenches are distributed at intervals around an axis, and each of the plurality of diversion trenches are configured for driving water to form a downward rotating motion to increase a water flowrate.

The flowrate-increasing drain valve according to the embodiment of the present disclosure at least has the following beneficial effects.

The flowrate-increasing drain valve with the above structure is provided with the diversion piece below the sealing sheet; when the sealing sheet is moved to open the upper end port of the drain channel, water rushes to the diversion piece from all directions to break an negative pressure area around the conventional sealing sheet, and the water enters the plurality of diversion trenches arranged around the circumference to form a downward rotating motion, thereby increasing a flow rate of the water entering the upper end port of the drain channel, improving a flushing pressure of the water-flow and further improving a flushing effect.

In some embodiments of the present disclosure, the diversion piece comprises a shaft piece and a plurality of diversion plates arranged on a peripheral wall of the shaft piece at intervals, each of the plurality of diversion trenches is defined between every two adjacent diversion plates and the outer peripheral wall of the shaft piece, and the plurality of diversion trenches are spirally arranged in clockwise or counterclockwise direction around an axis of the shaft piece.

In some embodiments of the present disclosure, the shaft piece is in a shape of a strip-shaped inverted frustum.

In some embodiments of the present disclosure, the plurality of diversion plates bend in clockwise or counterclockwise direction around the shaft piece, and a respective included angle between each of the plurality of diversion plates and the outer peripheral wall of the shaft piece gradually decreases from bottom to top.

In some embodiments of the present disclosure, the diversion piece is rotatably connected to the switch piece around the axis.

In some embodiments of the present disclosure, the switch piece comprises a vertically arranged connecting rod, the sealing sheet is mounted at a lower portion of the connecting rod, the connecting rod is provided with a pivot at a lower end of the connecting rod, the pivot is provided at its lower end with two lock hooks arranged back-to-back, bot of which are capable of deforming elastically along a radial direction of the pivot, and the diversion piece defines a shaft hole for the pivot and the elastically deformed lock hooks to pass through.

In some embodiments of the present disclosure, an outer periphery diameter of a lower end of the drain body is 2 inches or 3 inches.

In some embodiments of the present disclosure, the switch piece comprises a float rotatably connected to the drain body around a horizontal shaft, the sealing sheet is mounted on a lower end face of the float, and the float is connected at a middle of the float with a mounting base for clamping the sealing sheet, where the diversion piece is mounted on the mounting base, or the diversion piece is integrally formed with the mounting base.

In some embodiments of the present disclosure, the drain body is provided with an outer threaded pipe on an outer peripheral wall of the drain channel, the outer threaded pipe is provided with a stop step at an upper portion of the outer threaded pipe, and the outer threaded pipe is connected through outer threads with a locking sleeve located below the stop step.

In some embodiments of the present disclosure, the drain body is provided with a column sleeve at a lower end of the drain channel, an outer peripheral wall of the column sleeve is connected an inner peripheral wall of the drain channel through a plurality of rib plates, a mounting hook is arranged below the drain body, and a bolt penetrates through the column sleeve and is in threaded connection with the mounting hook.

Additional aspects and advantages of the present disclosure will be given in part in the following description, and will become apparent in part from the following description, or will be learned through the practice of the present disclosure.

BRIEF DESCRIPTION OF THE DRAWINGS

The above and/or additional aspects and advantages of the present disclosure will be more apparent from the following description of the embodiments in conjunction with the accompanying drawings, wherein.

REFERENCE NUMERALS

Figure 1:
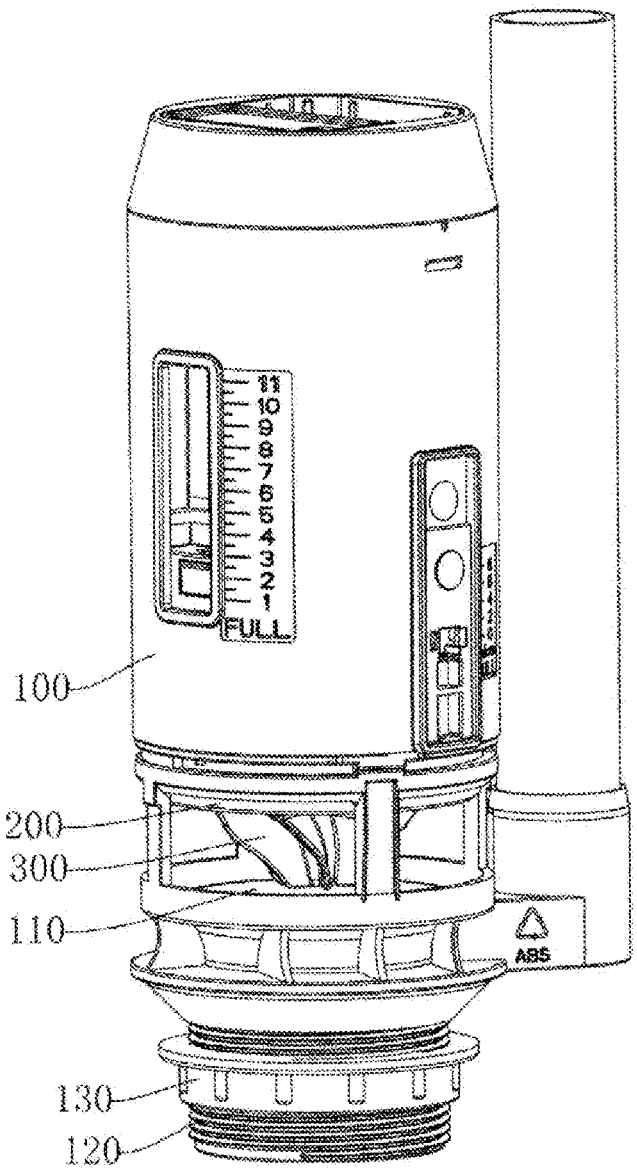
FIG. 1 is a schematic structural diagram of a first embodiment of a flowrate-increasing drain valve according to the present disclosure.

100—drain body; 110—drain channel; 120—outer threaded pipe; 130—locking sleeve; 140—column sleeve; 150—rib plate; 160—mounting hook; 200—switch piece; 210—sealing sheet; 220—connecting rod; 221—pipe sleeve; 222—stud; 230—pivot; 231—lock hook; 240—umbrella tray; 250—cover plate; 260—float; 270—mounting base; 300—diversion piece; 310—shaft piece; 311—shaft hole; 312—stop ring; and 320—diversion plate.

DETAILED DESCRIPTION

The embodiments of the present disclosure will be described in detail hereinafter. Examples of the embodiments are shown in the accompanying drawings. The same or similar reference numerals throughout the drawings denote the same or similar elements or elements having the same or similar functions. The embodiments described below by reference to the accompanying drawings are exemplary and are intended only to explain the present disclosure and are not to be construed as limiting the present disclosure.

In the description of the present disclosure, it should be understood that, the orientation or position relationship related to the orientation description, such as the orientation or position relationship indicated by the terms "upper", "lower", "front", "rear", "left", "right", "vertical", "horizontal", "top", "bottom", "inside", "outside" and the like is based on the orientation or position relationship shown in the drawings, which is only used for convenience of the description of the present disclosure and simplification of the description instead of indicating or implying that the indicated device or element must have a specific orientation, and be constructed and operated in a specific orientation, and thus should not be understood as a limitation to the present disclosure.

In the description of the present disclosure, the meaning of several refers to be one or more, and the meaning of multiple refers to be two or more. The meanings of greater than, less than, more than, etc., are understood as not including this number, while the meanings of above, below, within, etc., are understood as including this number. If there is a description to the first and second, it is only for the purpose of distinguishing technical features, and shall not be understood as indicating or implying relative importance, implicitly indicating the number of the indicated technical features or implicitly indicating the order of the indicated technical features.

In the description of the present disclosure, unless otherwise explicitly defined, the terms "setting", "mounting" and "connecting" should be understood a broad sense, for example, it may be fixed connection, detachable connection or integrated connection; may also be mechanical connection or electrical connection; and may be direct connection, may also be indirect connection through an intermediate medium, and may be communication inside two elements. For those of ordinary skills in the art, the specific meanings of the above terms in the present disclosure may be understood in specific situations.

Figure 2:
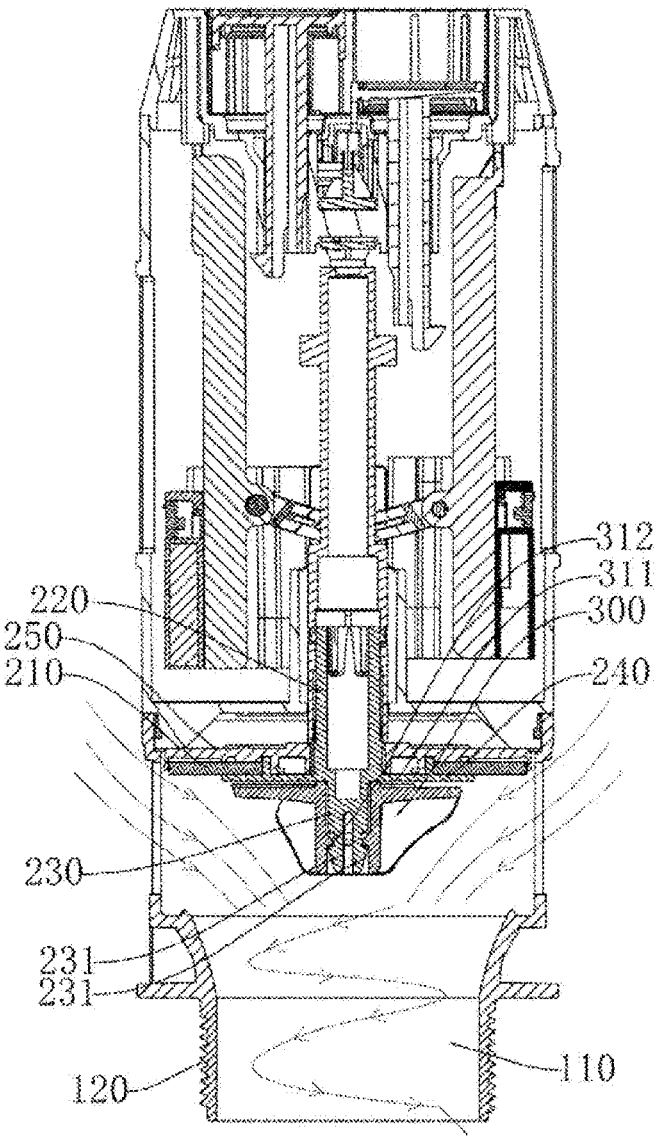
FIG. 2 is a schematic diagram showing an internal cross section of the embodiment of FIG. 1.
Figure 3:
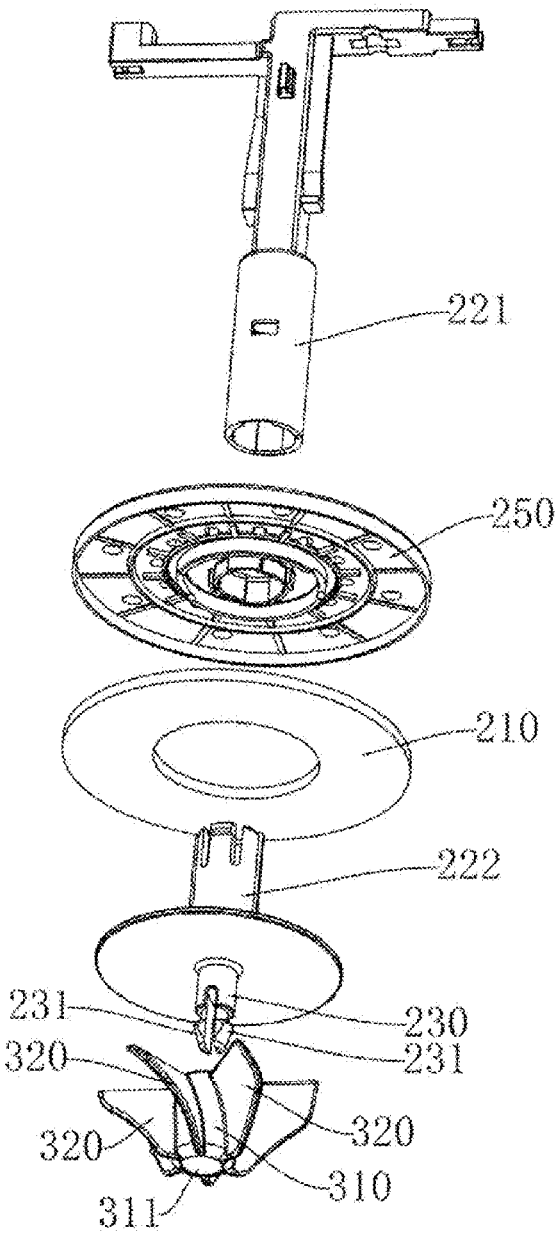
FIG. 3 is a schematic structural diagram of a second embodiment of the flowrate-increasing drain valve according to the present disclosure.

Referring to FIG. 1 to FIG. 3, the present disclosure provides a flowrate-increasing drain valve, comprising: a drain body 100, wherein the drain body 100 is provided with a vertically extending drain channel 110; a switch piece 200 movably connected to the drain body 100, wherein the switch piece 200 is provided with a sealing sheet 210 capable of being moved to open or close an upper end port of the drain channel 110; and a diversion piece 300 arranged on the switch piece 200 and located below the sealing sheet 210, wherein a plurality of diversion trenches are distributed at intervals around an axis circumference, and the diversion trenches are configured for driving water to form a downward rotating motion to increase a water-flow.

The flowrate-increasing drain valve with the above structure is provided with the diversion piece 300 below the sealing sheet 210. As shown in FIG. 2, line segments with an arrow indicate a water-flow path. When the sealing sheet 210 is removed to open the upper end port of the drain channel 110, water rushes to the diversion piece 300 from all directions, so that the water-flow changes from an irregular and disordered state to a vortex that rotates downward regularly. Meanwhile, the vortex defines usually a through hole without water flow in its center to destroy an effect of local vacuum adsorption. Therefore, the water flowrate is finally increased by a vortex flowrate increasing effect of the plurality of diversion trenches of the diversion piece 300, so that a water-flow rate is increased, and a water drain rate is improved. Therefore, when the flowrate-increasing drain valve of the present disclosure is adopted in sanitary ware, the sanitary ware can be flushed with a higher water-flow rate at the moment of flushing, so that a flushing effect of the sanitary ware is improved, the flow of water required for flushing is reduced, and water saving is realized.

Figure 6:
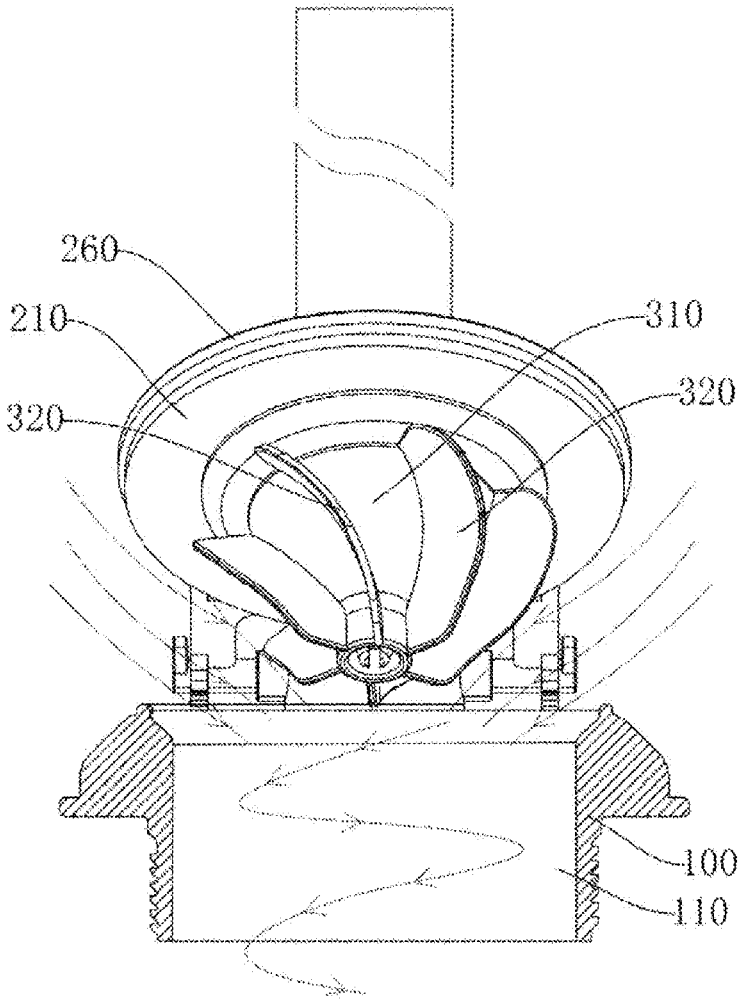
FIG. 6 is a schematic diagram of the flowrate-increasing drain valve of the embodiment of FIG. 5 configured for draining water.

Referring to FIG. 3, or referring to FIG. 6, in some embodiments of the present disclosure, the diversion piece 300 comprises a shaft piece 310 and a plurality of diversion plates 320 arranged on an outer peripheral wall of the shaft piece 310 at intervals, and one diversion trench is defined between two adjacent diversion plates 320 and the outer peripheral wall of the shaft piece 310. The diversion trenches are spirally arranged in clockwise or counterclockwise direction around an axis of the shaft piece 310. Spiral directions of all the diversion trenches are the same, and the spirally arranged diversion trenches are beneficial to guide the water-flow to form a spiral downward motion. A structure of mounting the diversion plate 320 on the shaft piece 310 is beneficial to processing and manufacturing, and is also beneficial to strictly controlling a depth dimension of the diversion trench along an extension direction thereof, thus helping to adjust an ideal water-flow shock wave. Specifically, in this embodiment, the spiral diversion trenches are less than one circle, and an angular displacement generated when the water-flow passes through the diversion trenches is small, which is beneficial for the water-flow to maintain a large kinetic energy and impact downward.

It should be noted that in some other embodiments, the diversion trench can also be arranged in a straight line, and the diversion trench is inclined relative to the axis of the shaft piece 310, so that the diversion trench can also guide the water-flow pass through the diversion trenches to form a downward rotating vortex. In other embodiments, the diversion trench can also be recessed along the outer peripheral wall of the shaft piece 310, for example, by means of integrally stamping or integrally injection molding.

Figure 5:
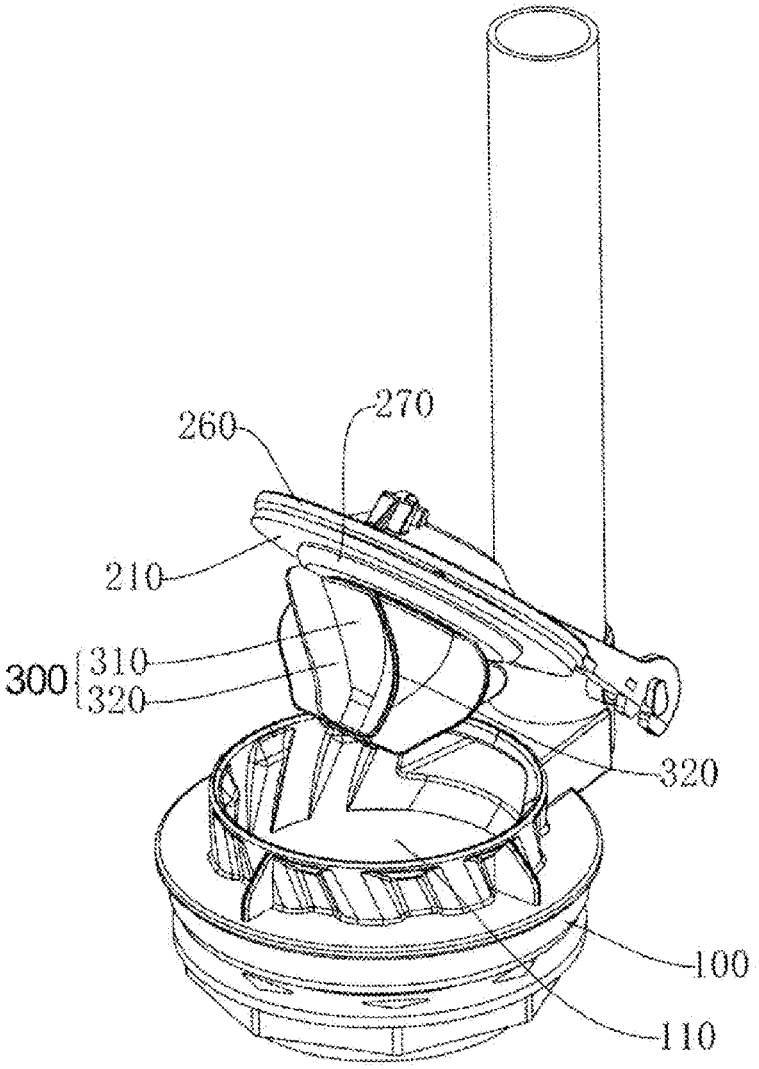
FIG. 5 is a schematic structural diagram of a third embodiment of the flowrate-increasing drain valve according to the present disclosure.

Referring to FIG. 5 and FIG. 6, in some embodiments of the present disclosure, the shaft piece 310 is in a shape of a strip-shaped frustum with an upper portion and a lower portion smaller than the upper portion. It may be understood that line segments with an arrow as shown in FIG. 6 indicate a water-flow path. The water entering the diversion trench is limited by two adjacent diversion plates 320, and is also limited by an outer peripheral surface of the shaft piece 310. The outer peripheral surface of the shaft piece 310 is frustum-shaped, which can guide the water to converge towards an axial position close to the shaft piece 310, thus forming a downward impacting water-flow, and further improving a flushing pressure of the water flow.

In some other embodiments, the shaft piece 310 is not limited to the strip-shaped inverted frustum, and a distance between a bottom wall of the diversion trench and the axis of the shaft piece 310 gradually decreases along a drain direction of the diversion trench. According to the principle of hydrodynamics, a diameter of a vortex formed by the water-flow passing through the diversion piece 300 gradually decreases down the drain channel 110. By the arrangement of the gradual decrease of the distance between the bottom wall of the diversion trench and the axis of the shaft piece 310 down the drain direction of the diversion trench, the dimension of the diversion trench adapts to a diameter of the vortex at a depth, so that the diversion trench can better guide the water-flow to form the vortex, thereby further improving a drain rate.

Referring to FIG. 3 or referring to FIG. 6, in some embodiments of the present disclosure, the diversion plate 320 bends in clockwise or counterclockwise direction around the shaft piece 310, and an included angle between the diversion plate 320 and the outer peripheral wall of the shaft piece 310 gradually decreases from bottom to top. That is, when the water enters an upper end of the diversion trench, a large angular displacement is generated. As the water flows to a lower end of the diversion trench, a flow rate of the water in each diversion trench along a length direction of the shaft piece 310 is large, which is conducive to the formation of a downward converging shock wave, and the shock wave also has a motion trend of multiple water-flows spirally encircling.

Referring to FIG. 2 and FIG. 3, in some embodiments of the present disclosure, the diversion piece 300 is rotatably connected with the switch piece 200 around the axis. It may be understood that when the diversion plate 320 is spirally arranged around the axis of the shaft piece 310 in clockwise or counterclockwise direction, the water flows to the diversion piece 300 from all directions and enters the diversion trench to form a rotation effect. In this case, the diversion piece 300 also has a relative rotation motion trend, and the rotation of the diversion piece 300 relative to the switch piece 200 can reduce a kinetic energy loss of the water-flow and ensure an impact force of the water-flow.

Moreover, in this embodiment, in order to realize that the water can rush to the upper end port of the drain channel 110 from all directions when the switch piece 200 rises, the drain body 100 is provided with a frame around the switch piece 200 and the diversion piece 300, and a plurality of upright posts are arranged at intervals in the frame, and water inlets are formed between adjacent upright posts, so that the water can enter the drain channel 110 from the water inlets in different directions. As the diversion piece 300 can rotate relative to the switch piece 200, a lateral opening of the diversion trench can rotate to face any water inlet, so as to avoid that part of the diversion trench always faces the upright post and affects the water intake, and further improve drain uniformity.

Referring to FIG. 2 and FIG. 3, in some embodiments of the present disclosure, the switch piece 200 comprises a vertically arranged connecting rod 220, the sealing sheet 210 is mounted at a lower portion of the connecting rod 220, the connecting rod 220 is provided with a pivot 230 at its lower end, the pivot 230 is provided at its lower end with two lock hooks 231, which are arranged back-to-back, capable of deforming elastically along a radial direction of the pivot 230. The diversion piece 300 defines a shaft hole 311 for the pivot 230 and the elastically deformed lock hooks 231 to pass through, and a stop ring 312 is provided corresponding to the lock hook 231 within the shaft hole 311. It can be understood that an aperture of the shaft hole 311 is adapted to a diameter of the pivot 230. Generally speaking, the connecting rod 220, the pivot 230 and the diversion piece 300 are all made of plastic materials. When assembling, force is applied to the two lock hooks 231 to drive the two lock hooks to approach each other. In this case, both the pivot 230 and the lock hooks 231 can pass through the shaft hole 311. When passing through the stop ring 312, the lock hooks 231 will recover elastic deformation thereof to prevent the diversion piece 300 from disengaging from the pivot 230. A function that the diversion piece 300 rotates relative to the switch piece 200 with a simple structure is realized.

In an embodiment, the connecting rod 220 includes a pipe sleeve 221 and a stud 222 inserted at a lower end of the pipe sleeve 221. The pivot 230 is formed at a lower end of the stud 222, and an umbrella tray 240 is formed at an outer periphery of the stud 222. A cover plate 250 located above the umbrella tray 240 is attached around the stud 222, and the lower end of the pipe sleeve 221 abuts against the cover plate 250 downward to clamp the sealing sheet 210 between the cover plate 250 and the umbrella tray 240. In an embodiment, a notch is defined on a side wall of the pipe sleeve 221, and the stud 222 is provided on an upper portion thereof with a clamping hook that can be elastically clamped in the notch. The cover plate 250 and the sealing sheet 210 are annular. When assembling, after the diversion piece 300 is rotatably connected to the pivot 230, the sealing sheet 210 is attached around the stud 222 and abutted against the umbrella tray 240, and then the cover plate 250 is attached around the stud 222 and abutted against the sealing sheet 210. When the stud 222 is inserted into the pipe sleeve 221 to clamp the clamping hook at the notch, the sealing sheet 210 is clamped and fixed.

In the existing technology, a dimension of a conventional drain valve usually is 2 inches or 3 inches, and an outer periphery diameter of the drain channel 110 is 2 inches or 3 inches. In some embodiments of the present disclosure, an outer peripheral diameter of a lower end of the drain body 100 is 2 inches or 3 inches, so as to adapt to a mounting structure of an existing sanitary ware product. It is conceivable that the flowrate-increasing drain valve provided by the present disclosure may also be set to other dimensions according to actual needs.

Referring to FIG. 5, in some embodiments of the present disclosure, the switch piece 200 comprises a float 260 rotatably connected to the drain body 100 around a horizontal shaft. The sealing sheet 210 is mounted on a lower end face of the float 260. A mounting base 270 for clamping the sealing sheet 210 is connected to the float 260 at a middle of the float 260. The diversion piece 300 is mounted on the mounting base 270 or the diversion piece 300 is integrally formed with the mounting base 270. That is to say, the diversion piece 300 can be mounted on either a cylinder drain valve or a float 260 drain valve, which broadens an application range.

Referring to FIG. 1, in some embodiments of the present disclosure, the drain body 100 is provided with an outer threaded pipe 120 on an outer peripheral wall of the drain channel 110, the outer threaded pipe 120 is provided on an upper portion with a stop step, and the outer threaded pipe 120 is connected through its outer thread with a locking sleeve 130 located below the stop step.

Figure 4:
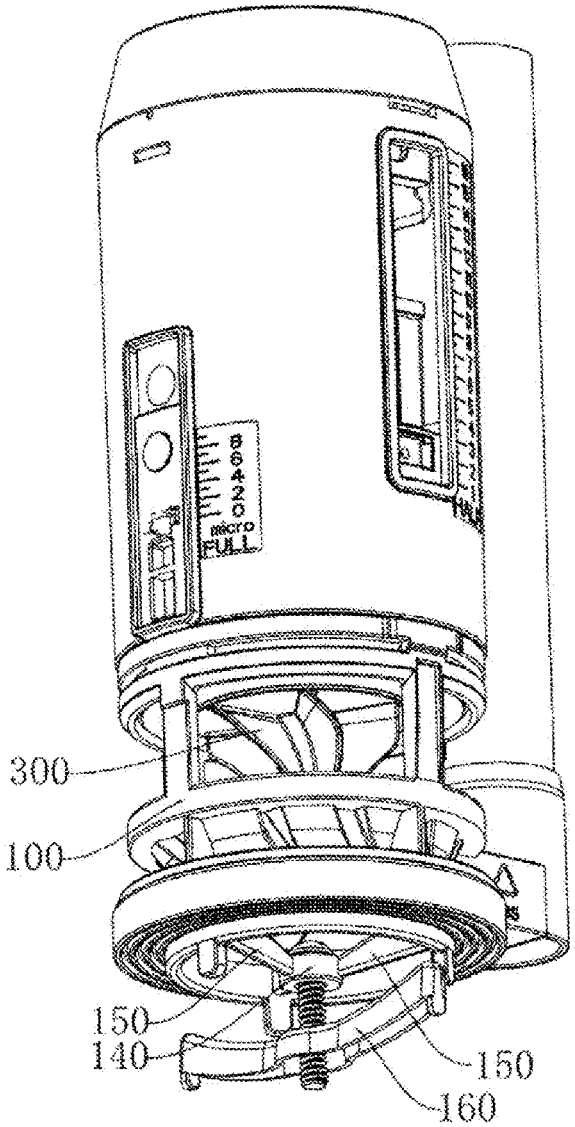
FIG. 4 is an exploded structural diagram of a diversion piece and a switch piece of the embodiment of FIG. 1.

In order to enrich mounting methods of different types of drain valves on a water tank of sanitary ware, referring to FIG. 4, in some embodiments of the present disclosure, the drain body 100 is provided with a column sleeve 140 at a lower end of the drain channel 110, and an outer peripheral wall of the column sleeve 140 is connected with an inner peripheral wall of the drain channel 110 through a plurality of rib plates 150. A mounting hook 160 is arranged below the drain body 100, and a bolt penetrates through the column sleeve 140 and is in threaded connection with the mounting hook 160.

The technical features of the above embodiments can be combined in any way. In order to simplify the description, not all the possible combinations of the technical features of the above embodiments are described. However, as long as there is no contradiction in the combinations of these technical features, they should be considered as falling within the scope recorded in this specification.

Although the embodiments of the present disclosure have been shown and described, those skilled in the art may understand that many changes, modifications, substitutions and variations can be made to these embodiments without departing from the principles and purposes of the present disclosure, and the scope of the present disclosure is defined by the claims and their equivalents.

What is claimed is:

1. A flowrate-increasing drain valve, comprising:

a drain body, wherein the drain body defines a vertically extending drain channel;

a switch piece movably connected to the drain body, wherein the switch piece is provided with a sealing sheet capable of being moved to open or close an upper end port of the drain channel; and a diversion piece arranged on the switch piece and located below the sealing sheet, wherein a plurality of diversion trenches are distributed at intervals around an axis, and each of the plurality of diversion trenches is configured for driving liquid to form a downward rotating motion to increase a flow rate of the liquid;

wherein the diversion piece is rotatably connected to the switch piece around the axis;

the switch piece comprises a vertically arranged connecting rod, the sealing sheet is mounted at a lower portion of the connecting rod, the connecting rod is provided with a pivot at a lower end of the connecting rod, the pivot is provided at a lower end of the pivot with two lock hooks arranged back-to-back, both of which are capable of deforming elastically along a radial direction of the pivot, and the diversion piece defines a shaft hole for the pivot and the elastically deformed lock hooks to pass through.

2. The flowrate-increasing drain valve according to claim 1, wherein:

the diversion piece comprises a shaft piece and a plurality of diversion plates arranged on an outer peripheral wall of the shaft piece at intervals, each of the plurality of diversion trenches is defined between every two adjacent diversion plates and the outer peripheral wall of the shaft piece, and the plurality of diversion trenches are spirally arranged in clockwise or counterclockwise direction around an axis of the shaft piece.

3. The flowrate-increasing drain valve according to claim 2, wherein:

the shaft piece is in a shape of a strip-shaped inverted frustum.

4. The flowrate-increasing drain valve according to claim 2, wherein:

the plurality of diversion plates bend in clockwise or counterclockwise direction around the shaft piece, and a respective included angle between each of the plurality of diversion plates and the outer peripheral wall of the shaft piece gradually decreases from bottom to top.

5. The flowrate-increasing drain valve according to claim 1, wherein:

an outer periphery diameter of a lower end of the drain body is 2 inches or 3 inches.

6. The flowrate-increasing drain valve according to claim 1, wherein:

the switch piece comprises a float rotatably connected to the drain body around a horizontal shaft, the sealing sheet is mounted on a lower end face of the float, and the float is connected at a middle of the float to a mounting base for clamping the sealing sheet, wherein the diversion piece is mounted on the mounting base, or the diversion piece is integrally formed with the mounting base.

7. The flowrate-increasing drain valve according to claim 1, wherein:

the drain body is provided with an outer threaded pipe on an outer peripheral wall of the drain channel, the outer threaded pipe is provided with a stop step on an upper portion of the outer threaded pipe, and the outer threaded pipe is connected with a locking sleeve located below the stop step through outer threads.

8. The flowrate-increasing drain valve according to claim 1, wherein:

the drain body is provided with a column sleeve at a lower end of the drain channel, an outer peripheral wall of the column sleeve is connected with an inner peripheral wall of the drain channel through a plurality of rib plates, a mounting hook is arranged below the drain body, and a bolt penetrates through the column sleeve and is in threaded connection with the mounting hook.

* * * * *